US012320079B2

(12) United States Patent
Verhaelen et al.

(10) Patent No.: US 12,320,079 B2
(45) Date of Patent: Jun. 3, 2025

(54) METHOD FOR OPERATING A GROUND MILLING MACHINE

(71) Applicant: Wirtgen GmbH, Windhagen (DE)

(72) Inventors: Philip Verhaelen, Lohmar (DE); Bernd Walterscheid, Sankt Augustin OT Buisdorf (DE); Sascha Spöth, Heistenbach (DE); Florian Peters, Blankenheim (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 17/857,213

(22) Filed: Jul. 5, 2022

(65) Prior Publication Data

US 2023/0010051 A1 Jan. 12, 2023

(30) Foreign Application Priority Data

Jul. 7, 2021 (DE) ..... 10 2021 117 493.7

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 8,738,304 | B2 * | 5/2014 | Hall | G05B 19/4065 702/34 |
| 9,121,146 | B2 | 9/2015 | Paulsen et al. | |
| 10,167,721 | B2 * | 1/2019 | Berning | E21C 25/10 |
| 10,287,882 | B2 | 5/2019 | Barimani et al. | |
| 10,385,688 | B2 * | 8/2019 | Laclef | B28D 1/188 |
| 11,236,611 | B2 | 2/2022 | Berning et al. | |
| 2011/0121633 | A1 * | 5/2011 | Hall | G07C 3/02 299/39.2 |

FOREIGN PATENT DOCUMENTS

| | | | |
|---|---|---|---|
| DE | 102015111249 | A1 | 1/2017 |
| DE | 102016113251 | A1 | 4/2017 |
| EP | 2716816 | A1 | 4/2014 |
| EP | 3260603 | A1 | 12/2017 |

* cited by examiner

*Primary Examiner* — Janine M Kreck
(74) *Attorney, Agent, or Firm* — Gary L. Montle; Lucian Wayne Beavers; Patterson Intellectual Property Law, PC

(57) ABSTRACT

The invention relates to a method for operating a ground milling machine, in particular a road milling machine, a stabilizer, a recycler, a surface miner or the like, having an interchangeable milling drum, wherein the milling drum is equipped with a plurality of milling tools, in particular round shank picks, wherein the milling drum has a current state, wherein a control unit is provided for controlling at least one function of the ground milling machine, and wherein the milling drum has a characteristic feature or a characteristic feature is assigned to the milling drum. According to the invention, provision is made that at least one data set containing information on the current state of the milling drum is stored in a storage unit, the characteristic feature identifying the milling drum is assigned to the data set in the storage unit, and this data set is transmitted to a processing device.

23 Claims, 10 Drawing Sheets

METHOD FOR OPERATING A GROUND MILLING MACHINE

CROSS-REFERENCES TO RELATED APPLICATIONS

This application claims the benefit of German Patent Application No. DE 10 2021 117 493.7, filed Jul. 7, 2021, and which is hereby incorporated by reference.

FIELD OF THE INVENTION

The invention relates to a method for operating a ground milling machine, in particular a road milling machine, a stabilizer, a recycler, a surface miner or the like, having an interchangeable milling drum, wherein the milling drum is equipped with a plurality of milling tools, in particular round shank picks, wherein the milling drum has a current state, wherein a control unit is provided for controlling at least one function of the ground milling machine, and wherein the milling drum has a characteristic feature or a characteristic feature is assigned to the milling drum.

BACKGROUND

A road milling machine having a milling drum is known from German patent reference DE 10 2016 113 251. The milling drum is equipped with a characteristic feature. A suitable reader can be used to read this characteristic feature. The characteristic feature is evaluated in a control unit and then the road milling machine recognizes which type of milling drum it is. Different types of milling drums are designed to perform different work tasks. A so-called fine milling drum is used to remove the upper part of the surface course of a road pavement by milling. In particular, slight irregularities in the road surface can be removed. The resulting surface course can be immediately opened for the use of road traffic. Another type of milling drum is used to remove a complete road surface. Furthermore, special milling drum types are designed for different work tasks, e.g., with regard to working width, milling depth or desired milling texture.

After the road milling machine has automatically recognized the milling drum type based on the characteristic feature of the milling drum, the control unit can preset a suitable machine parameter set. This machine parameter set can be used to operate the road milling machine in a suitable manner.

Another German reference DE 10 2015 111 249 A1 discloses a road milling machine in which preset machine parameters, material properties of the substrate to be milled and job data can be entered. Using characteristic diagrams, suitable target machine parameters can be computed from these default values. The target machine parameters can be displayed to the machine operator who can then decide whether to set these target machine parameters at the milling machine. Alternatively, the target machine parameters can be automatically transferred to a control unit for controlling the road milling machine.

Additional documents EP 2 716 816 A1 and EP 3 260 603 A1 disclose road milling machines having a sensor system. The sensor system can be used to record the volume milled by a road milling machine.

Finally, road milling machines having detection devices are known. These detection devices can be used to automatically determine the wear of the milling tools.

The milling machines described above facilitate completing the upcoming milling task for the machine operator. After the milling task is completed, the milling machine is transported to the next job site, where the installed milling drum type can be used to complete the set requirements.

If the milling drum is in a partially worn state, it can continue to be used. If the milling tools are completely worn, the milling tools have to be replaced. After the replacement, the milling machine can then continue to be operated at the construction site.

BRIEF SUMMARY

The present invention addresses the problem of providing a method for operating a ground milling machine, which can be used to optimize the planning and execution of upcoming milling tasks.

This problem is solved by at least one data set containing information on the current state of the milling drum being stored in a storage unit, by a characteristic feature identifying the milling drum being assigned to the data set in the storage unit, and by transmitting this data set to a processing device.

According to the invention, the state of the milling drum is stored. This state can be detected directly, for instance, by measuring the milling drum. For instance, an optical measurement method can be used for this purpose, which, for instance, uses a laser scanner to measure the milling tools and compares the result to a measurement result of the milling drum in the unworn state.

Preferably, however, the state is determined indirectly, for instance using job data and/or material characteristics of the material removed and/or the set machine parameters that were recorded or taken into account during the tool insertion of the milling tools.

Material parameters in the context of the invention can be the abrasiveness and/or the hardness and/or a material type (for instance asphalt or concrete) and/or a material composition and/or a temperature and/or a layer structure of the surface to be removed.

The current state can also be entered manually. In particular, it is conceivable to manually set an initial state and then update it automatically during operation.

For instance, provision may be made that the existing picks of a milling drum are replaced with new or partially worn picks. The operator of the ground milling machine can then manually enter the current state of these picks and in that way manually set the initial state. During operation, this state is then updated automatically, as described above.

Job data are, in particular, data that have been or will be recorded during the operation of the milling drum, for instance the milled surface, the milling volume and/or the milled mass of the material removed and/or the milling duration.

Feasible set machine parameters in the context of the invention are machine parameters that are or have been set to be defined or variable during a working operation of the milling drum, for instance, the milling depth, the feed rate, the milling drum speed, the motor power transmitted to the milling drum and/or the torque transmitted to the milling drum. One or more of these machine parameters can be part of a machine parameter set.

The current state of the milling drum may include and/or comprise one or more of the wear components listed below:

wear of one or more picks;

wear of one or more pick holders;

wear of one or more base parts, each of which holds a pick holder and is connected to the surface of the milling drum:

wear at the milling drum rotor;

wear at ejectors.

The current state of the milling drum can be determined solely by one of the aforementioned wear components and stored in the data set.

However, as mentioned above, in the context of the invention, the current state of the milling drum can also be characterized by a tuple comprising at least two of the aforementioned wear components and these are taken into account in the data set.

If several wear components are considered in a data set, it is particularly conceivable that depending on the type of milling drum, one wear type can be dominant and is assessed accordingly in the data set, or that a combination of wear types is considered and/or only the most heavily worn components have to be considered.

The current state of the milling drum can also be taken into account as at least one key figure in the data set, wherein the key figure contains, for instance, information on the remaining useful life of the milling drum or which can be derived from the remaining useful life of the milling drum. It is also conceivable that the key figure indicates a residual wear capacity.

The key figures can represent the current state of the milling drum and in that way permit conclusions to be drawn concerning the work results that can be achieved using the milling drum and/or the work output that can still be achieved by the milling drum.

The current state of the milling drum may also include a qualitative assessment. In particular, it can be indicated accordingly whether the milling drum is still basically usable. The qualitative classification can also take into account the efficiency of the milling drum in completing a milling task or the quality of the work result that can be produced by the milling drum, for instance in the form of a percentage. It is also conceivable to take a large number of key figures for individual milling drum components into account in the data set.

A single key figure and/or a qualitative assessment can also be derived as an "overall state of wear" from the overall consideration of a large number of key figures.

After the state of the milling drum has been detected, a data set according to the invention is formed that reflects the current state of the milling drum. In the storage unit this data set is linked to the characteristic feature individualizing the milling drum. In other words, the characteristic feature is a unique identifier of an individual milling drum. The data set can then be transferred to a processing device. For this purpose, the processing device can be arranged at the ground milling machine, for instance. It is also conceivable to spatially separate the processing device from the ground milling machine. For instance, it is conceivable that the processing device is at least temporarily in wired or wireless communication with the ground milling machine.

An additional processing device may also be provided.

The further processing device and the processing device may be combined into a joint unit, or provision may preferably be made that the processing device and the further processing device are spatially separated from each other.

The data set can be evaluated in the further processing device. Using the characteristic feature of the milling drum, which can be used to uniquely identify the milling drum and from which the type of milling drum can be derived, a computation unit determines whether this milling drum is generally suitable for an upcoming milling task. Then, in the further processing device, the determination can be made whether this milling drum, which is generally suitable, meets certain requirements wherein the current state results from the data set.

Within the scope of the invention, the milling drum which is actually best suited for the upcoming task can also be selected in the further processing device from a pool of milling drums, which are generally suitable according to their milling drum type for performing the upcoming milling task.

The suitability of the milling drum can be determined by considering the current state of the pool's milling drums. As a criterion, it can be specified, for instance, that the individually most suitable milling drum is filtered out of the pool, for instance using the further processing device, which can be used to perform the upcoming task most quickly, efficiently, or cost-effectively.

It is conceivable to classify the current state of the milling drum according to predefined criteria. A user or the further processing device can then determine if the milling drum complies with the set requirements for a scheduled milling assignment.

It is also conceivable that, at the request of an operator, the further processing device determines whether the milling drum in question is sufficiently suitable for an upcoming milling task.

If several data sets of different milling drums are stored in the memory device, the further processing device can inform the user on request which of the milling drum(s) is/are suitable for the scheduled milling assignment.

In the further processing device, for instance, the usability, the quality of the work result that can be produced with the milling drum and/or the efficiency of the milling drum can be determined. These parameters can be derived in particular from the stored data set containing the current state of the milling drum.

If the quality of the milling drum is assessed, the further processing device can for instance be used to determine which milling texture quality can be produced using the present milling drum. For instance, the milling drum in question or the milling drums in a pool can be assigned to a quality scale on the basis of the data set, or a determination can be made whether the required milling texture quality can be produced using that milling drum.

If the efficiency of the milling drum is determined, the further processing device determines which machine parameters are required to operate the milling drum as intended based on the present current state of the milling drum. For instance, it is possible to determine which drive power and/or which drive torque has to be applied for the intended use to achieve the desired work result. In correlation, the consumption of consumables (for instance, fuel consumption and/or coolant consumption) for the intended use can be determined.

When determining the usability (functionality) of the milling drum, a data set can be used to determine whether the milling drum is still basically usable for the intended or scheduled use.

The operation of a ground working machine is subject to requirements, for instance, to comply with economic or time specifications. One or more job data can be specified to comply with such specifications as well. Job data, as already mentioned above, are in particular data that have been or will be recorded during the operation of the milling drum, for instance the milling area, the milling volume and/or the milling mass of the material removed and/or the milling duration. In the context of the invention, job data may also include, for instance, a scheduled change to the material to be worked on, for instance, a milling path, a milling power, a milling work and/or a milling work time.

For instance, a mass or a milling volume of the material to be removed can be specified as the milling work. This may result in a required milling path and milling depth. A work per time can be specified as the milling power, for instance a mass to be machined per unit of time, a volume of material to be worked on per time or a surface or distance to be machined per unit of time. Working time may include the point in time when a given job has to be completed. It can further indicate an opportune moment to change the ground working tools, such as at the end of a shift or a scheduled downtime of the ground milling machine.

A characteristic feature in terms of the invention can in particular be an individualizing marking applied to the milling drum at a suitable location, for instance a bar code, a sequence of numbers or letters. A characteristic feature may also be an identifier present in or on an optically or electrically readable element, such as an active or passive transponder, for instance an RFID transponder or the like.

In the simplest case, the machine operator manually detects the characteristic feature of the milling drum.

Alternatively, provision may preferably be made for a reader to read the characteristic feature of the milling drum. The reader may be part of the ground milling machine or may be connected to the ground milling machine via a wired or wireless line to transmit data.

It is conceivable for the reader to be part of a separate computing unit designed to make wireless contact with the control unit of the ground milling machine. The separate computing unit can then be used to uniquely and wirelessly identify a milling drum. The separate computing unit may comprise the storage unit, in which the characteristic feature of the milling drum is linked to the data set containing information on the milling drum. The data set can then be transmitted to the processing device.

Preferably, the storage unit can be arranged on the milling drum, on which the characteristic feature and the data set containing information on the current state of the milling drum are linked. For instance, the storage unit may be an electronically readable and writable medium. In this case, a characteristic feature and/or the data set can be retrieved using a suitable reader, for instance, when the milling drum is changed, and transmitted directly to the processing device.

Alternatively, the storage unit is designed separately from the milling drum. Accordingly, after the characteristic feature on the milling drum has been detected (which can be done manually, for instance), the data set assigned to this characteristic feature and containing information on the current state of the milling drum has to be transferred from the storage unit to the processing device. For this purpose, provision may be made, for instance, to design the storage unit as a database, in which characteristic features and data sets are linked. Once the characteristic feature of the milling drum has been detected, the assigned data set containing information on the current state of the milling drum can be determined and transmitted to the processing device.

Accordingly, the processing device stores a data set of the current state of the milling drum before the start of a milling task. If the milling task is then subsequently performed, the milling tools are subject to wear. The state of the milling drum changes accordingly, compared to the initial state. During or after completion of the milling task, the change in the state of the milling drum resulting from the milling task can then be assessed or determined. The processing device then generates a new data set from the originally stored data set of this milling drum and the change in state that occurred during the milling task, which then reflects the current state of the milling drum. This new data set therefore represents an updated data set that takes into account the last milling task performed. Thus, it represents the state of the milling drum after the milling task has been performed Accordingly, each milling task, for instance, can be considered as a single wear event. The resulting change in the state of the milling drum is combined with the state of the milling drum in a computation before the milling task is performed to determine the current state of the milling drum.

However, it is also conceivable for the ground milling machine to continuously determine the change in the state of the milling drum during the completion of a milling task and that a data set containing information on the then current state of the milling drum is generated at the end of the milling task. This variant takes into account the fact that the tools, which wear increasingly during the working process, affect the machine parameters and tool wear.

Preferably, a new data set containing information on the current state of the milling drum is transmitted back to the memory device.

After completion of the milling work, a (new) data set containing information on the current state of the milling drum is available in the processing device. This new data set is then preferably transmitted to the memory device and linked to the characteristic feature of the milling drum.

Alternatively, the data set containing information on the current state of the milling drum can also be transmitted to the storage unit during milling operation in regular intervals and stored linked to the characteristic feature of the milling drum.

If the storage unit is located on the milling drum and, in particular, is designed as an electronically readable and writable medium, the new data set can be transferred to the storage unit on the milling drum at the end of the milling task.

During the milling operation, the milling drum identified by the characteristic feature is assigned to a ground milling machine. After completion of the milling task, milling data from the ground milling machine can be forwarded to the separate computing unit for the determination of the data set. Then, only after the milling work is completed, based on the milling data of the ground milling machine, a new data set containing information on the current state of the milling drum is generated. This is then also transmitted to the storage unit and linked to the characteristic feature of the milling drum.

It is also conceivable to provide the further processing device on the separate computing unit. At the request of a user, for instance, the separate computing unit can then assess whether a milling drum identified by the separate computing unit is suitable for an upcoming milling task. This result can then be transmitted from the separate computing unit to the operator.

For instance, a machine operator on the shop floor may have a large number of milling drums at his disposal. The machine operator now asks whether one of the milling drums is suitable for an upcoming milling task. The separate computing unit determines the milling drums available on site and then provides the operator with feedback on the milling drums suitable for the upcoming milling task. The machine operator can then select a suitable milling drum and install it in the ground milling machine.

To determine the characteristic feature, provision may be made for the milling drum to have an active transmitting element that transmits the characteristic feature and/or the data set to a reader. In this way, the storage location of the milling drum can be detected, for instance by the separate computing unit or other reader. For instance, it is then possible to determine whether a particular milling drum is at a construction site or in the workshop.

Here, provision may be made that the milling drum has a position transmitter designed to transmit a position signal, preferably at regular time intervals or permanently, and that the milling drum transmits the characteristic feature and/or the data set wirelessly in conjunction with the position signal, wherein the position transmitter preferably is a GPS transmitter.

It is also conceivable for the milling drum to have a passive reading element and for a reader to read it out to record the characteristic feature and/or the data set. An operator can then use a suitable reader to check various milling drums available to him for their suitability for a particular milling task.

In this context, it is conceivable that the active transmitting element is an active RFID, or that the passive reading element is a passive RFID or a readable code, in particular a bar code, a QR code or the like.

As mentioned above, provision may be made within the scope of the invention for the storage unit, in which the data set is stored, to be part of the milling drum or part of the separate computing unit.

It is conceivable to store the data set in a suitable storage unit of the milling drum. A suitable reader can then be used to transfer this data set to the processing device, which can preferably be provided at the ground milling machine. However, it is also conceivable to transmit the data set from the separate computing unit to the processing device, which can preferably be provided at the ground milling machine. This will considerably simplify the procedure.

A particularly preferred variant of the invention is designed in such a way, that during the milling operation of the ground milling machine milling data, in particular the milling duration, the milled material volume and/or the milled surface, are recorded, and that these milling data or a computed combination thereof are combined as an additional data set with the data set, preferably in the processing device, and a new data set is generated therefrom, which new data set characterizes the new current state of the milling drum. In this way, the state of the milling drum is updated and tracked. Provision may be made that the additional data set is continuously combined with the data set or at time intervals during the milling operation. In this way, the state of the milling drum can be tracked at different points in time.

It is also conceivable that the additional data set is combined with the data set after the milling operation. Accordingly, after the milling task has been completed, the new data set, which provides information on the current status of the milling drum, can be generated and stored in the storage unit.

Within the scope of the invention, provision may be made that at least one of the pieces of information listed below is acquired as milling data during the milling operation of the ground milling machine and is taken into account when generating the new data set:

- the milling duration;
- the milled material volume;
- the milled surface;
- the milling depth;
- the average milling depth;
- a load profile;
- an average load profile;
- the mechanical load on the milling drum during at least part of the milling duration;
- the average load on the milling drum during at least part of the milling duration;
- the load on the milling tools;
- the average load on the milling tools;
- the number of overload events, (for instance, an overload event occurs when the milling drum hits a hard object in the material being milled, such as a metal part or a manhole cover);
- information on the type of material milled (the type of milled material can be, for instance, concrete or asphalt);
- information on the temperature of the milled material and/or the ambient temperature;
- information on whether milling was performed with or without loading of the milled material (in the case of loading, the milled material is removed directly from the working area of the milling drum and removed using a transport device, for instance an endlessly circulating conveyor belt. During the milling operation, without loading, the milled material remains on the road surface behind the milling drum. When milling without loading, the milling tools and the milling drum are in contact with the milled material for a longer period of time resulting in heavier wear);
- the feed and/or the drive power of a drive motor transmitted into the milling drum;
- the average feed and/or the average drive power of a drive motor transferred into the milling drum;
- the speed of the milling drum.

Within the scope of the invention, provision may be made that the new data set is transmitted to the milling drum, the ground milling machine and/or the separate computing unit.

Provision may be made within the scope of the invention that by means of an input unit, which can preferably be provided at the ground milling machine, at least one preset machine parameter and/or at least one material characteristic value of the material to be milled and/or job data is/are recorded, and that the further processing device is designed to determine from the at least one preset machine parameter and/or the at least one material characteristic value and/or the job data whether the milling drum is suitable for an upcoming milling task.

By specifying job data, the further processing device can determine whether a milling drum is generally suited to perform the required task. For instance, the job data can specify that the milling drum is to be used for a fine milling task, full removal of a roadway surface or partial removal of a roadway surface. For appropriately selected job data, further an assessment can be made, taking into account the data set, whether this milling drum, which is generally suitable, is also suitable in concrete terms for completing a specific task. For instance, the job data can be used to specify that the milling drum has to mill a certain volume of material at a specified milling depth.

According to the invention, provision may be made that an operator selects a working mode by means of an input unit.

For instance, different job data can be combined in one working mode. The operator can use the working mode to specify, for instance, how efficiently the ground milling machine should complete the set milling task. For instance, the working mode can be used to select that the ground milling machine is to use the lowest possible amount of one or more operating media (for instance, fuel, coolant) (eco mode). According to another working mode, provision may be made for the ground milling machine to be operated at the lowest possible wear of the milling tools to complete the set milling task. According to a further working mode, provision may be made, for instance, for the set milling task to be completed in a time-optimized manner, for instance as quickly as possible.

The further processing device determines, taking into account the selected mode and the data set, whether the set milling task can be completed using a certain milling drum. In addition or alternatively, provision may be made that a control unit of the ground milling machine, depending on the selected operating mode and taking into account the data set, suitably sets or suggests to the operator the machine parameters for operating the ground milling machine, matched to the selected operating mode.

In addition to the characteristic feature, provision may be made that at least one definite feature of the milling drum and/or the milling tools, is used. This definite feature may be stored, for instance in the storage unit, or may be linked to the characteristic feature as part of the data set. One or more of the definite features can/may be selected from the list below:

- information on the usability of the milling drum-information on the type of milling drum;
- information on the number of picks installed on the milling drum;
- information on the type of pick holder in which the milling picks are installed;
- information on the line spacing of the milling pick on the milling drum.

In the design of the data set containing information on the current state of the milling drum, provision may be made for the data set to contain at least one variable feature of the milling drum and/or the milling tools selected from the list below:

- information on the state of wear of the at least one milling tool;
- information on the state of wear of a pick holder in which the at least one milling tool is installed;
- information on the state of wear of an ejector mounted on the milling drum (ejectors are components installed on the of milling drums that eject the material milled by the milling tools from the working area of the milling drum. These ejectors are subject to wear and have to be replaced when they reach their maximum state of wear)
- information on the state of wear of the milling drum rotor of the milling drum (the milling tools are installed directly or indirectly on the milling drum rotor. The milling drum rotor is subject to continuous wear, reducing the thickness of the milling drum rotor. When the milling drum rotor reaches a minimum thickness, it has to be replaced);
- information on the residual wear capacity of the at least one milling tool;
- information on the residual wear capacity of the at least one pick holder in which the at least one milling tool is installed;
- information on the residual wear capacity of an ejector installed on the milling drum;
- information on the residual wear capacity of the milling drum rotor of the milling drum;
- information on the probability of failure of the milling drum;
- information on the quality of a milling texture, which can be generated using the milling drum;
- information on the efficiency of the milling drum.

The problem of the invention is also solved using a milling arrangement having a ground milling machine, in particular having a road milling machine, having a stabilizer, having a recycler, having a surface miner or the like, having an interchangeable milling drum, wherein the milling drum is equipped with a plurality of milling tools, wherein the milling drum has a current state, wherein a control unit is provided for controlling at least one function of the ground milling machine, and wherein the milling drum has a characteristic feature. According to the invention, provision is made that at least one data set is stored in a storage unit, which contains information on the current state of the milling drum, that the characteristic feature identifying the milling drum is assigned to the data set in the storage unit, and that this data set or a computed combination containing the data set is transmitted to a processing device.

For instance, the computing units, computers, or such computer systems, of the external computing unit or the ground milling machine described in this patent application may include at least one processor, one computer-readable storage medium, one database, one input unit, and one output unit, not shown. The input unit can be a keyboard or other user interface and permits an operator to enter instructions. The output unit can be designed as a display or as another visual or acoustic display. The processor may be implemented as a single controller comprising all of the described functionality, or multiple controllers may be provided, among which the described functionality is distributed. As used herein, computer-readable storage medium means any form of nonvolatile storage medium that contains a computer program product in the form of software executable by the processor, computer instructions, or program modules. When executed, these may provide data or otherwise cause the computer system to implement an instruction or, as defined herein, operate in a specific manner. Provision may further be made that more than one type of storage media is used in combination to route software, computer instructions, or program modules executable by the processor from a first storage medium in which the software, computer instructions, or program modules are initially stored to the microprocessor for execution. The storage media as used herein can be transmission media or data storage media, without constituting a restriction thereto. Data storage media can be equally volatile and non-volatile, removable and non-removable. These can be in the form of dynamic memory, ASICs (Application Specific Integrated Circuits), memory chips, optical or magnetic memory (CD), flash memory, or any other medium suitable for storing data in a form suitable for processors. They may be located on a single computer platform or distributed across multiple such platforms unless otherwise specified.

Transfer media may include any tangible media suitable for processor-executable software, computer instructions, or program modules to be read and executed thereon by a processor. Cables, wires, fiber optics or known wireless media can be used for this purpose without restriction. In another embodiment, provision may be made that the processor does not represent or require a computer system. It may be implemented separately or otherwise independently configured within a machine, such as in a general-purpose processor, digital signal processor (DSP), application specific integrated circuit (ASIC), field programmable gate array (FPGA), or other programmable logic device, discrete gate or logic transistor circuit, discrete hardware components, or any combination thereof designed or programmed to perform or perform the functions described. The general-purpose processor may be a microprocessor or alternatively a microcontroller, a state machine, or a combination thereof. The processor may also be implemented as a combination of computing devices, such as a combination of a DSP with a microprocessor, a plurality of microprocessors, one or more microprocessors in conjunction with a DSP core, or any other such combination. Depending on the embodiment, certain actions, sequences, or functions of each of the algorithms described with respect to the controller may be performed in a different order, may be added or combined, or may be omitted (for instance, if not all of the described functions are required to execute the algorithm). Further, in certain embodiments, actions, operations, or functions may be performed simultaneously, for instance, by multi-threaded processing, interrupted processing, or by multiple processors or processor cores or any other parallel architecture.

BRIEF DESCRIPTION OF THE SEVERAL VIEWS OF THE DRAWINGS

The invention is explained in greater detail below based on exemplary embodiments shown in the drawings.

In the drawings.

DETAILED DESCRIPTION

Figure 1:
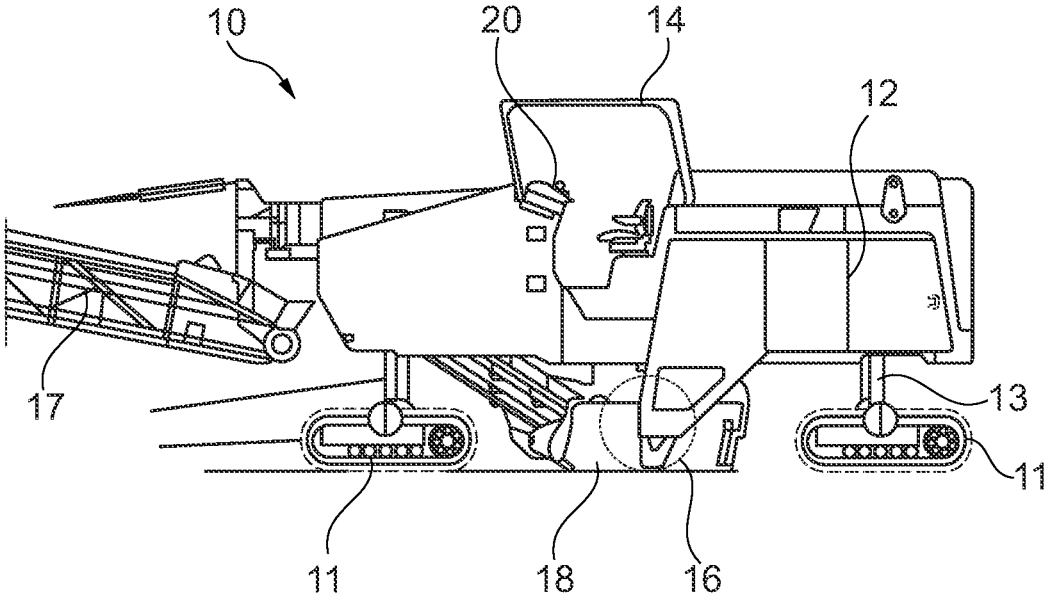
FIG. 1 shows a schematic diagram and a side view of a road milling machine.

FIG. 1 shows a schematic diagram and a side view of a ground milling machine 10 in the form of a road milling machine. A machine frame 12 is supported by trolleys 11, for instance crawler tracks, via four lifting columns 13 in a height-adjustable manner. The ground milling machine 10 can be operated, based on a control station 14, via a control 20 arranged in the control station 14. A milling drum 16 is rotatably mounted in a roller housing 18, which is obscured from view and shown dashed in the illustration. A conveyor 17 is used to remove the milled material.

In use, the machine frame 12 is moved on the ground to be worked on at a feed rate entered via the control 20. Milling tools, in particular picks, in particular round shank picks, arranged on the rotating milling drum 16 remove the substrate.

The control 20 can be used to adjust the vertical position and the speed of the milling drum 16. The milling depth is set via the vertical position of the milling drum 16. Depending on the machine type, the height-adjustable lifting columns 13 or other suitable means can be used to adjust the vertical position of the milling drum 16. Alternatively, the height of the milling drum 16 can be adjustable relative to the machine frame 12, such as in the ground milling machine 10 shown in FIG. 2, which is designed as a stabilizer.

Figure 2:
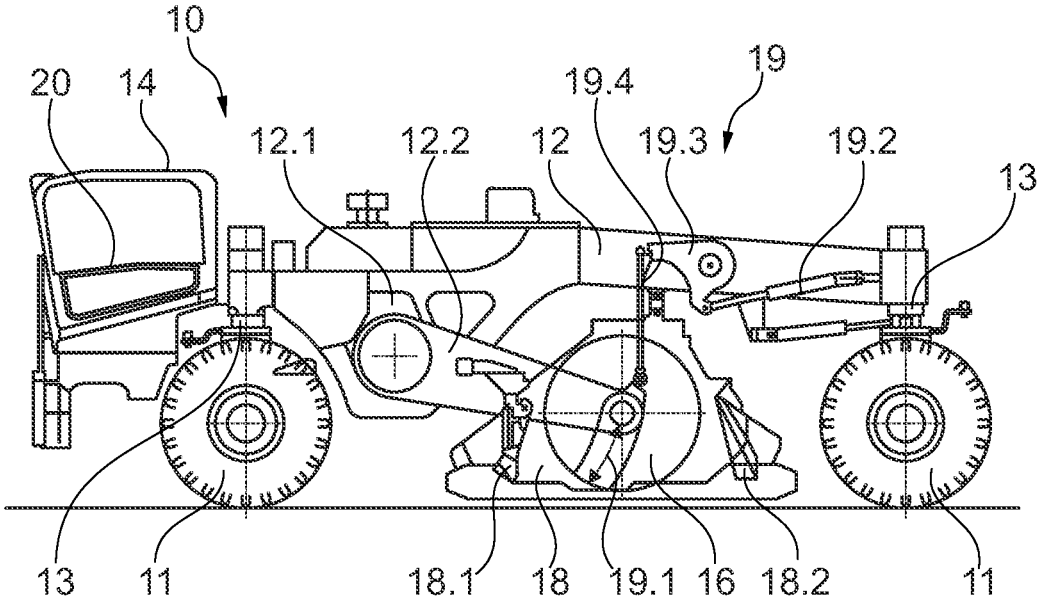
FIG. 2 shows a schematic diagram and a side view of a stabilizer.

FIG. 2 shows a schematic diagram and side view of a second ground milling machine 10 in the form of a stabilizer. The second ground milling machine 10 is moved by means of undercarriages 11 designed as front and rear wheels. The front and rear wheels are attached to the machine frame 12 by front and rear lifting columns 13, to be able to adjust the working height of the machine frame 12 and thus of the roller housing 18. A control station 14 is installed at the machine frame 12. The motor 12.1 arranged inside the machine frame 12 drives the milling drum 16 via a drive unit 12.2. The milling drum 16 itself is mounted in the roller housing 18, which has a front and a rear roller flap 18.1, 18.2 assigned thereto. The roller flaps 18.1, 18.2 are each designed to be adjustable via an attached hydraulic system. A hydraulic height adjuster 19 can be used to adjust the height of the milling drum 16 along an adjustment path 19.1 indicated by a double arrow. For this purpose, a rotatably mounted deflection lever 19.3 and an adjusting rod 19.4 arranged thereon transmit the motion of a hydraulic cylinder 19.2 to the milling drum 16. The height adjuster can be used to adjust the milling depth.

Figure 3:
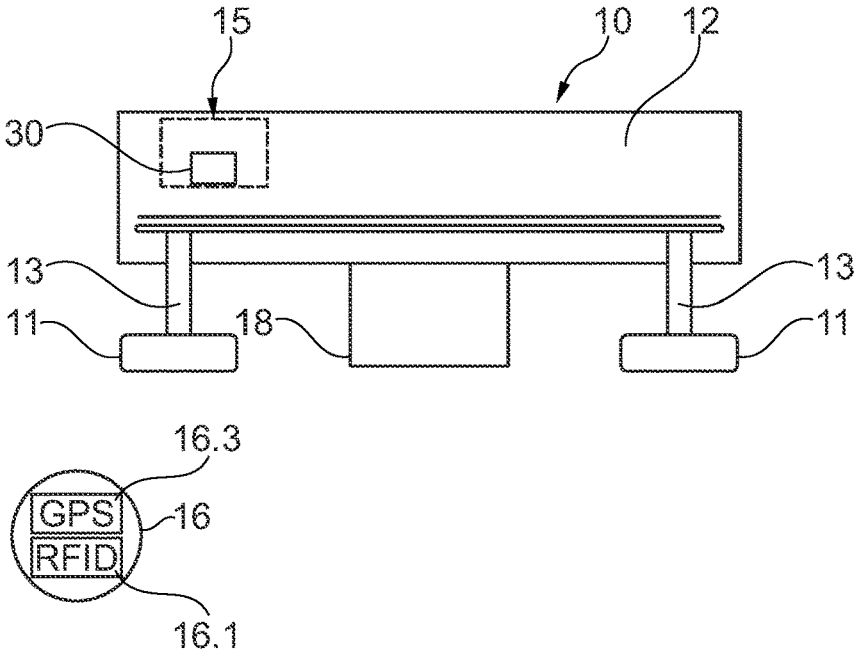
FIGS. 3 to 9 show different operating states of a road milling machine.

FIG. 3 shows a further simplified representation of a ground milling machine 10, for instance a ground milling machine 10 of the type shown in FIG. 1 or 2.

The ground milling machine 10 has a machine frame 12 to which four travel units 11, for instance crawler tracks, are coupled via four lifting columns 13. In the area between the front and rear trolleys 11, a milling drum 16 can be mounted in an interchangeable manner, for instance in a roller housing 18.

The ground milling machine 10 has a control unit 15. Part of this control unit 15 may be a processing device 30, or may comprise a processing device 30. The processing device 30 may also be provided as a separate unit preferably at the ground milling machine 10.

In the context of the invention, the processing device 30 may also comprise or form a further processing device.

Alternatively, the processing device 30 and/or the further processing device may be arranged separately from the ground milling machine 10.

As FIG. 3 shows, the milling drum 16 is stored separately from the ground milling machine 10. The milling drum 16 has a milling drum rotor. Milling tools can be mounted to the surface of the milling drum rotor in a directly or indirectly interchangeable manner. For instance, it is conceivable that a pick holder is used to indirectly or directly interchangeably connect a milling tool to the surface of the milling drum rotor. It is further conceivable that a milling tool can be mounted in an interchangeable manner in a pick holder, and the pick holder can be connected to a base part in an interchangeable manner. The base part is connected, for instance welded, to the surface of the milling drum rotor.

The milling drum 16 may have a position transmitter 16.3, for instance. This position transmitter 16.3 can be a GPS module, for instance, which transmits a position signal, for instance at regular intervals or permanently.

This milling drum 16 is equipped with a characteristic feature 16.4. It can be contained in a storage unit 16.1, for instance. Accordingly, the characteristic feature 16.4 may be a readable code stored in the storage unit 16.1. It is also conceivable that the characteristic feature 16.4 is formed by a sequence of letters and/or digits, a bar code, or a QR code or any other readable coding.

The characteristic feature 16.4 may include, or be linked to, information regarding a unique identifier of the milling drum 16 and/or information regarding the type of milling drum and/or information regarding the type of pick holder and/or information regarding the number of milling tools installed on the milling drum 16 and/or information regarding the line spacing of picks arranged linearly on the milling drum 16. In this respect, the characteristic feature 16.4 is a definite feature of the milling drum 16.

As mentioned above, the milling drum 16 can be installed with the ground milling machine 10. A reader can be used to read out the characteristic feature 16.4. In this exemplary embodiment, the storage unit 16.1 is an RFID transponder, in which the characteristic feature 16.4 is stored. An RFID reader can be used to read the characteristic feature from the RFID transponder. The reader may be part of the ground milling machine 10 or the reader may be a separate device, for instance a hand-held device, by means of which the characteristic feature 16.4 is read at the milling drum 16.

Figure 4:
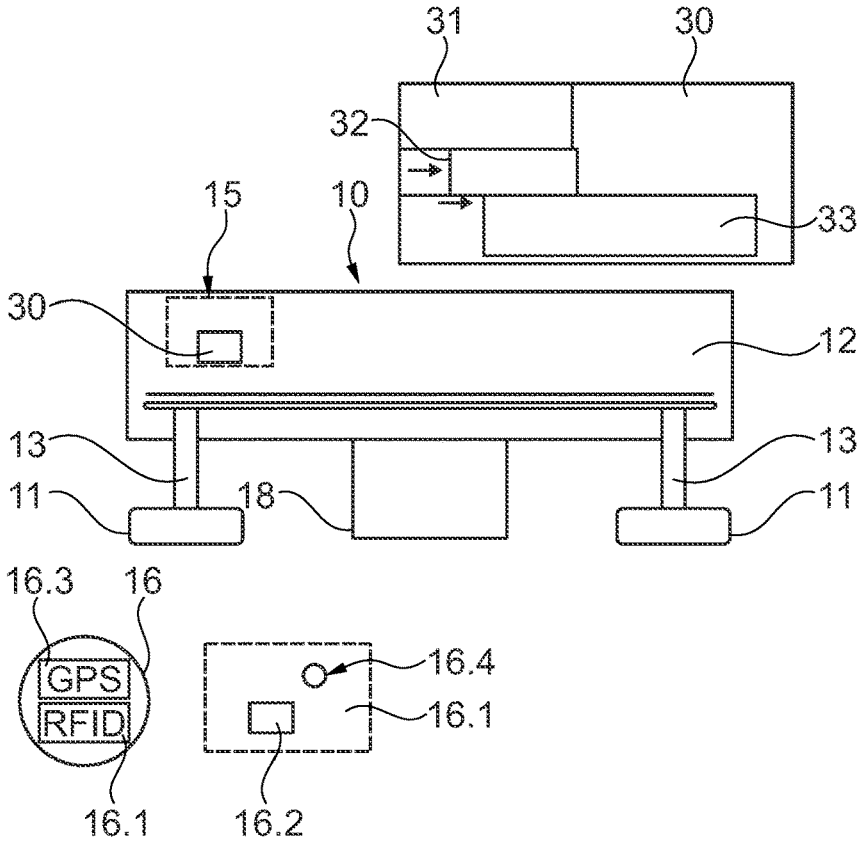

FIG. 4 illustrates that a data set 16.2 is stored in the storage unit 16.1. This data set 16.2 contains information on the current state of the milling drum 16. Accordingly, the data set 16.2 may contain the information that at least one milling tool and/or the milling drum 16 is/are in an unworn state or that at least one milling tool or the milling drum 16 is partially worn. In this way, this information can include a statement on the actual quantitative wear and/or information on the actual quantitative residual wear capacity of at least one milling tool and/or the milling drum 16.

Additionally or alternatively, information providing an indication of the state of wear and/or residual wear capacity of at least one pick holder, at least one base part, at least one ejector installed on the milling drum, and/or the milling drum rotor can be encoded in the data set 16.2. These are therefore variable features of the milling drum 16.

Additionally or alternatively, information on the milling texture quality to be expected may be encoded in the data set, wherein this encoding provides an indication of whether a certain milling texture quality or which milling texture quality can be milled with the present milling drum 16. It is conceivable that the expected milling texture quality is coded based on variable characteristics of the milling drum 16. Alternatively, a statement on the milling texture quality to be expected can also be generated in a separate computing unit, where these variable features are fed and which evaluates these variable features.

Additionally or alternatively, the data set 16.2 may also include information on the efficiency and/or usability of the milling drum 16. Conceivably, the expected efficiency or usability is coded based on variable characteristics of the milling drum 16. Alternatively, a statement on the efficiency or usability to be expected can also be generated in a separate computing unit 40, where these variable features are routed and which evaluates these variable features.

In addition, the data set 16.2 may also include information on a definite feature of the milling drum, such as the type of milling drum, the number of picks installed on the milling drum, the type of pick holder in which the milling picks are installed, and/or the line spacing of the milling picks on the milling drum.

FIG. 4 shows one or more memories being provided in the processing device 30. There may be a memory 31 for definite features, a memory 32 for variable features, and a memory 33 for computed and combined features. Of course, the memories 31, 32, 33 can form a joint memory. The memory 33 for computed and combined features contains computed features formed from a computed combination of one or more of the definite features and/or one or more of the variable features.

Accordingly, one or more definite feature(s), one or more variable feature(s)/or one or more computed and combined feature(s) of a milling drum 16 may be stored in the processing device 30.

Figure 5:
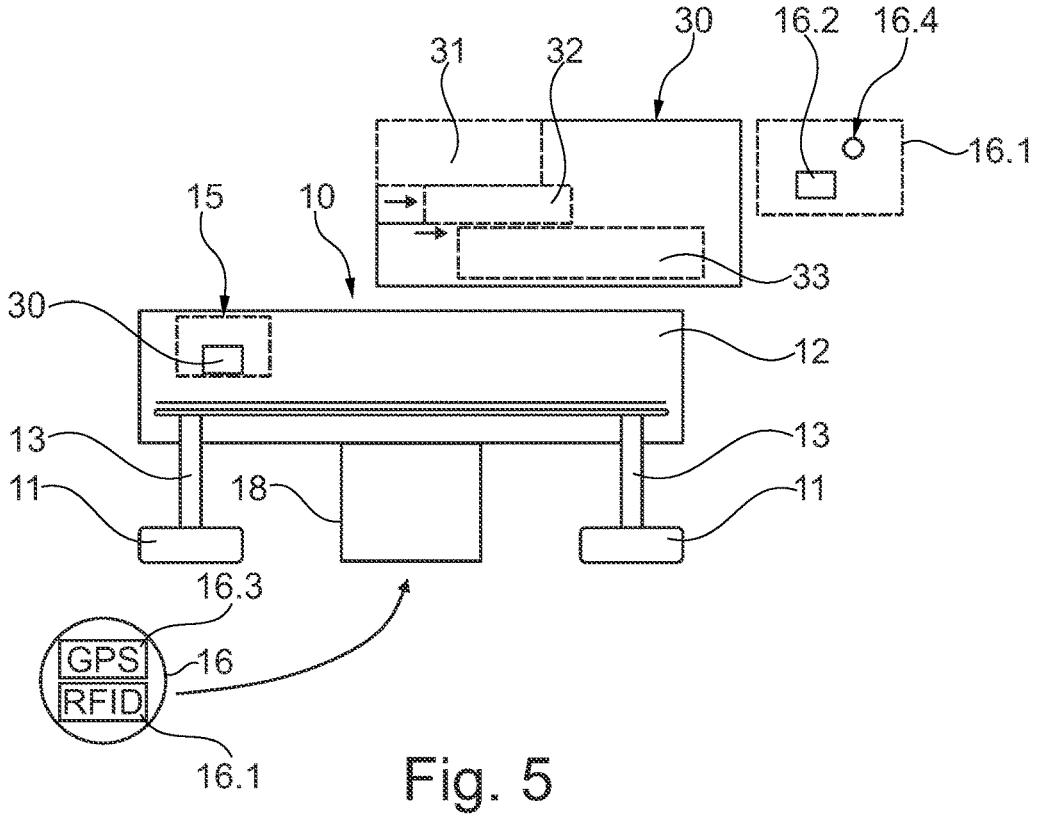

FIG. 5 shows that the milling drum 16 is installed in the milling drum box 18 of the ground milling machine 10. Before the milling drum 16 is installed or when the milling drum 16 is installed, the storage unit 16.1 is read out.

Any information on the milling drum held in the storage unit forms the data set 16.2, which contains information on the current state of the milling drum 16. This data set 16.2 is transferred to the processing device 30. Accordingly, the definite features are stored in the definite features memory 31 and the variable features are stored in the variable features memory 32. A computational unit selects the features to be computed and combined from one or more of the definite features and one or more of the variable features. The computed and combined features are stored in the memory 33 for computed and combined features.

Figure 6:
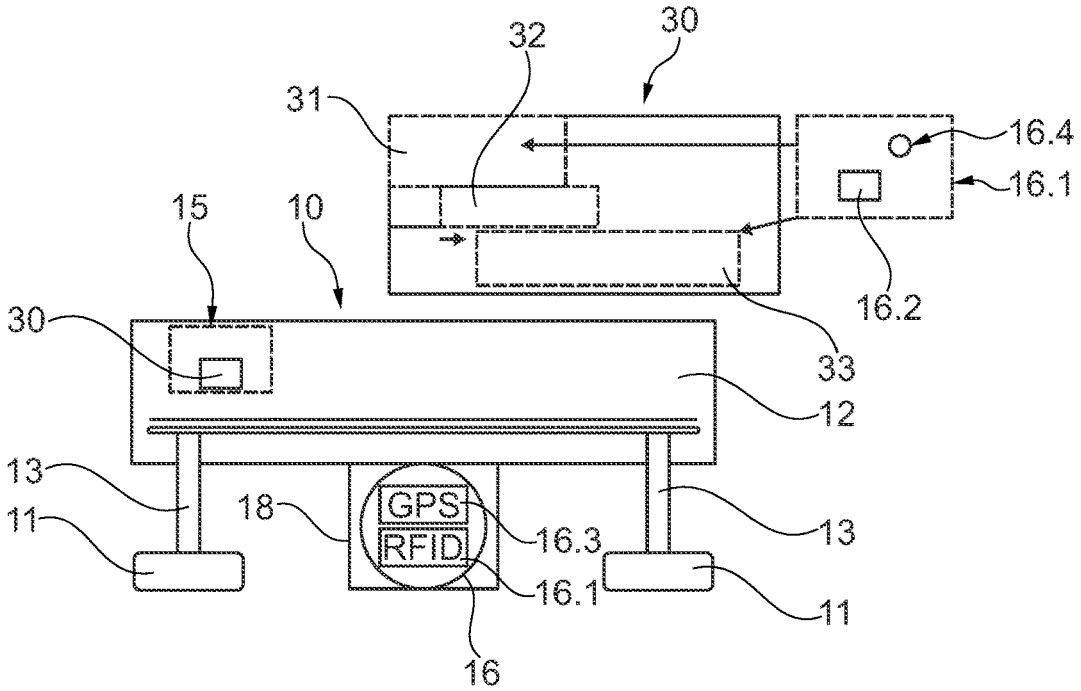
Figure 7:
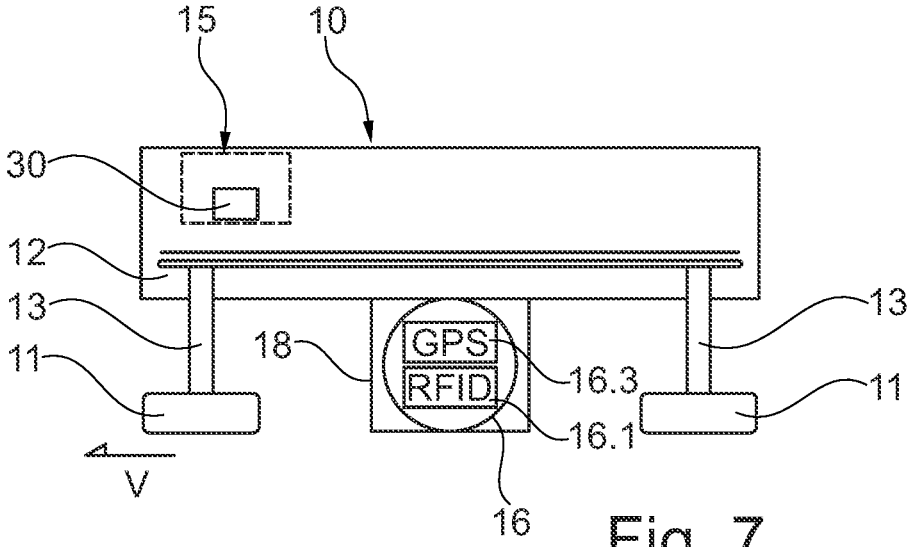

According to FIGS. 6 and 7, the ground milling machine 10 can be transferred to the milling operation. One or more relevant operating variables of the ground milling machine 10 are determined during the milling operation or after the milling operation. Suitable transducers, for instance, sensors record, for instance, the duration of operation of the ground milling machine, the volume of material milled out, the average or detailed milling depth, the average or detailed mechanical load, for instance, the engine power or drive torque, the average or detailed feed, the force/or load on the milling picks on average or detailed, and/or the number of overload events.

In addition or alternatively, the type of milled material, for instance asphalt or concrete, can also be recorded as a relevant operating variable and/or it can be recorded whether milling took place with or without removal of the milled material and/or information on the number of milling drum changes can be recorded.

Figure 8:
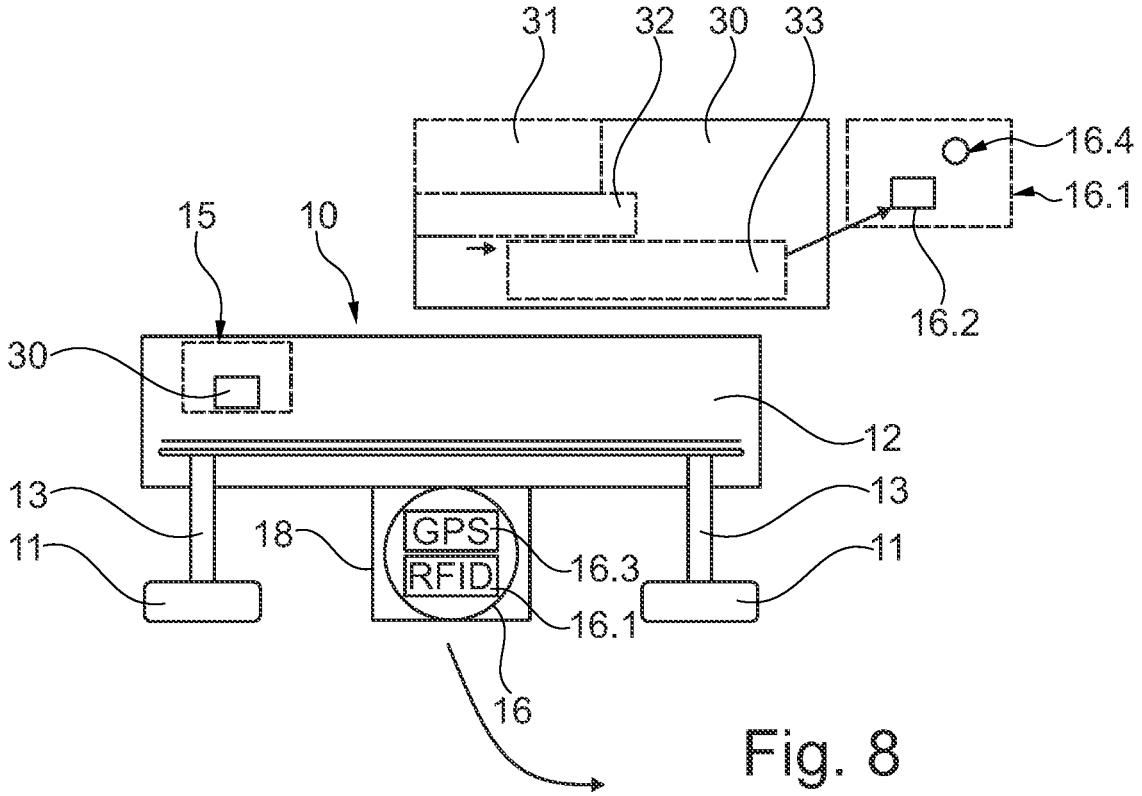

From the relevant operating variables, changes in the wear of the milling drum 16 or a part of the milling drum 16 are computed in a computation unit and provided as an additional data set. A new data set is created in the computation unit taking into account the data set 16.2 and the additional data set. This new data set is stored in the storage unit 16.1, as FIG. 8 shows. This new data set then forms the data set 16.2, which provides information on the current status of the milling drum 16.

FIG. 8 further illustrates that the milling drum 16 can be removed after the milling process has been completed.

Figure 9:
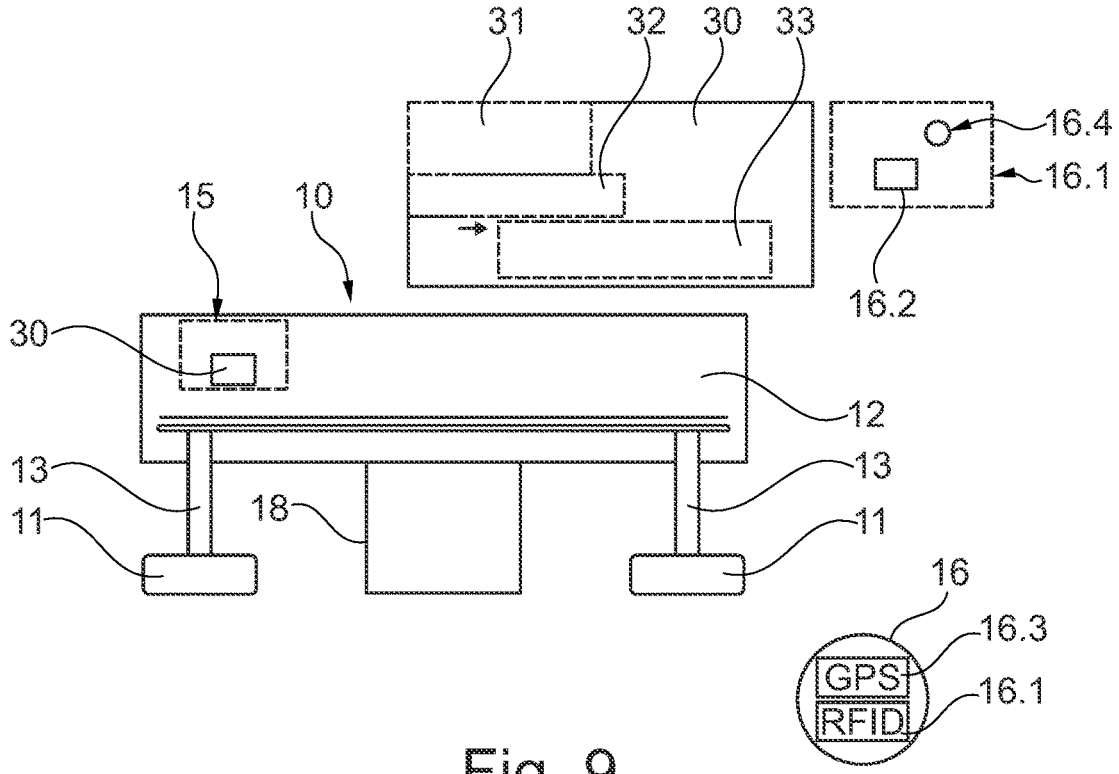

According to FIG. 9, the removed milling drum 16 now contains the data set 16.2 and is available for reuse. For instance, the memories 31, 32, 33 in the processing device 30 may now be erased and/or the data contained therein may be used elsewhere.

FIGS. 10 to 17 show a further variant of the embodiment of this invention. As shown in these images, a separate computing unit 40 is provided. This separate computing unit 40 has a connection to a wireless network, such as a telephone line or the Internet. Furthermore, a receiving circuit may be assigned to the computing unit 40 or this computing unit 40 may comprise a receiving circuit suitable for receiving and evaluating the signal emitted by the position transmitter 16.3 to locate the position of the milling drum. It may, for instance, be a GPS receiver.

Figure 10:
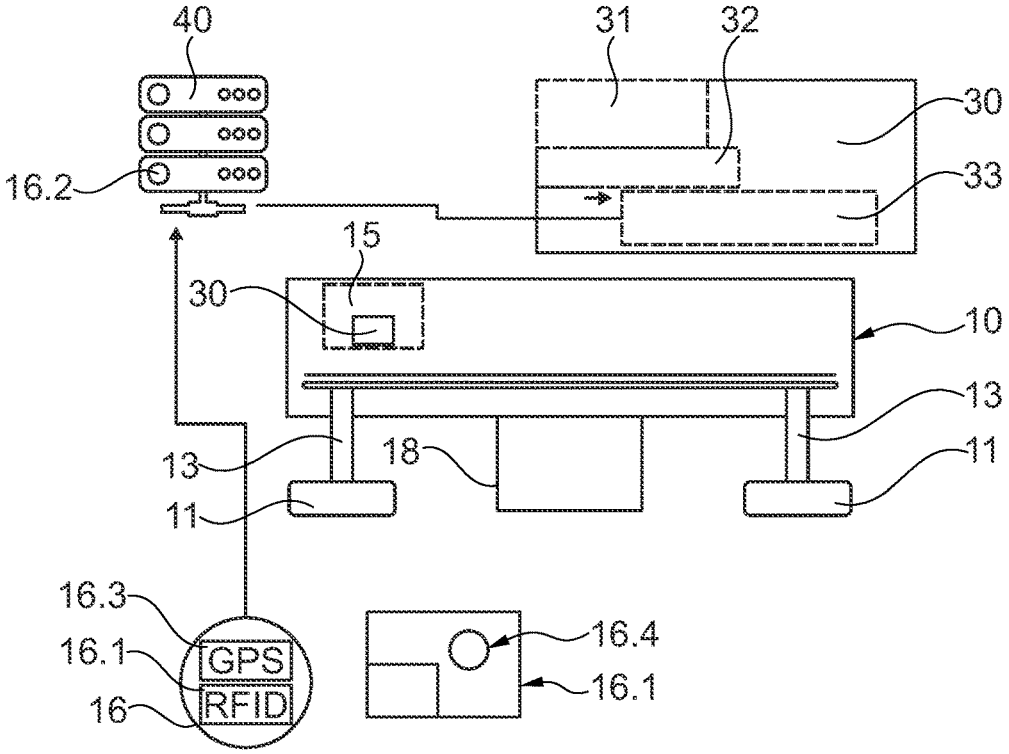
FIGS. 10 to 17 show various operating conditions of a further embodiment of a road milling machine.

FIG. 10 further illustrates that a connection to the ground milling machine 10 can be established via a telephone line or via the Internet.

It is conceivable that the ground milling machine 10 also has a GPS transmitter, whose signal the computing unit 40 can receive and evaluate to locate the position of the ground milling machine 10.

The milling drum 16 is again similar in structure to the milling drum 16 according to the exemplary embodiment shown in FIGS. 1 to 9. Reference can therefore be made to the above statements. The actuating arrangement 16 also has a storage unit 16.1. At least one characteristic feature 16.4 of the milling drum 16 is again stored in a readable form in the storage unit 16.1.

FIG. 10 shows that the computing unit 40 can use the position transmitter 16.3 to detect the position of the milling drum 16. The signal emitted by the milling drum 16 can also be used to transmit the characteristic feature 16.4 of the milling drum 16 to the computing unit 40. This information may be modulated onto the signal transmitted by the position transmitter 16.3.

The computing unit 40 has a memory. This memory stores the data set 16.2, which contains information on the current state of milling drum 16 and is linked to the characteristic feature 16.4.

Figure 11:
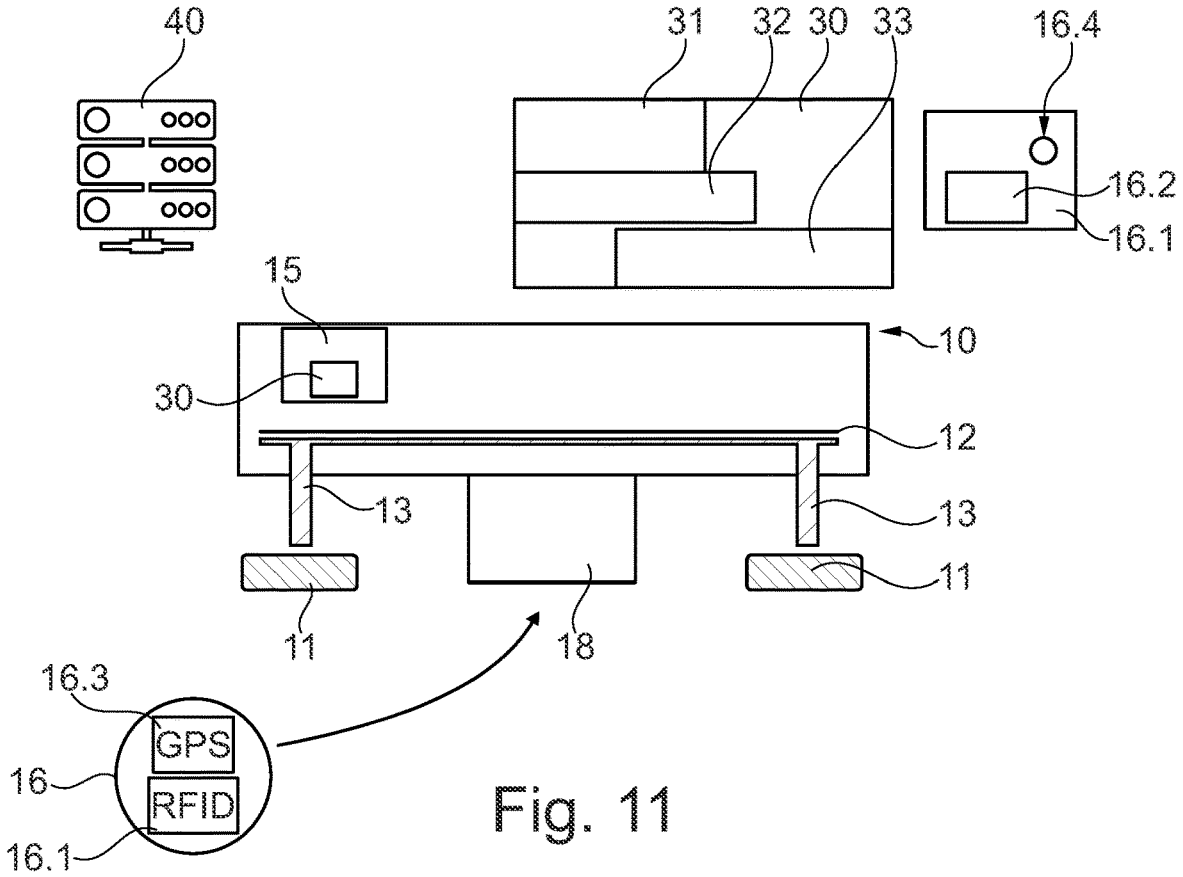

FIG. 11 illustrates that the milling drum 16 can again be assembled with the ground milling machine 10. Before or after the installation of the milling drum 16, the characteristic feature 16.4 of the milling drum 16 can be detected, in accordance with the exemplary embodiment according to FIGS. 1 to 9.

Figure 12:
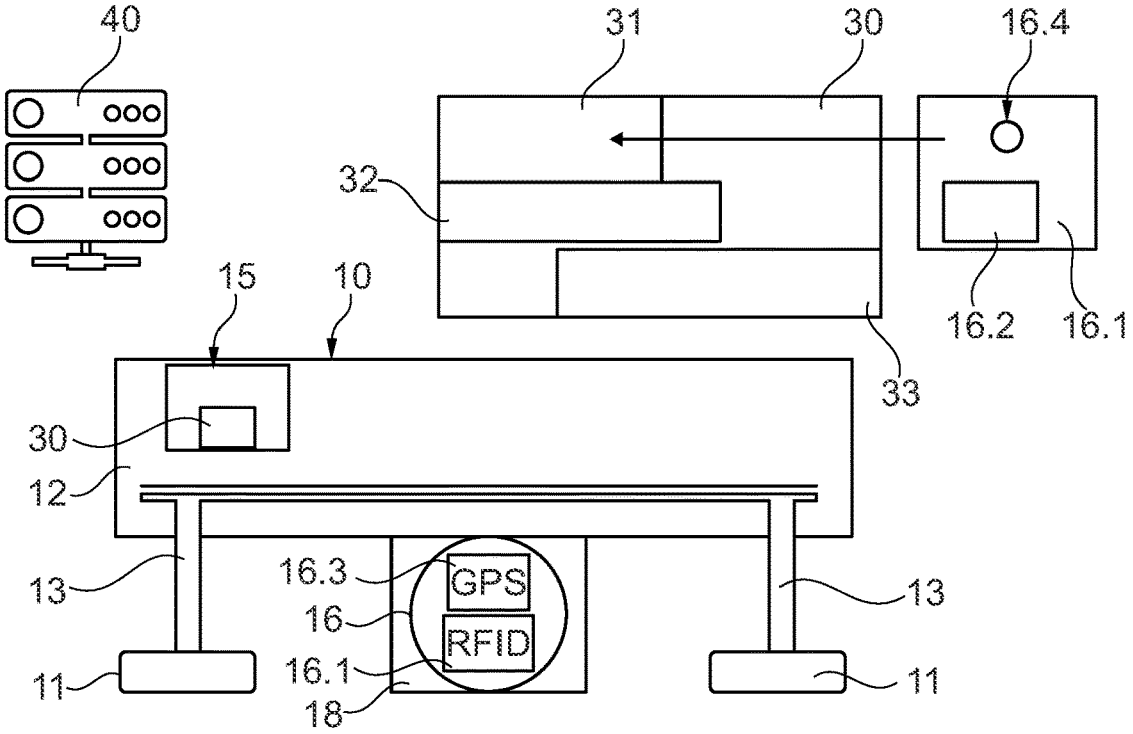
Figure 13:
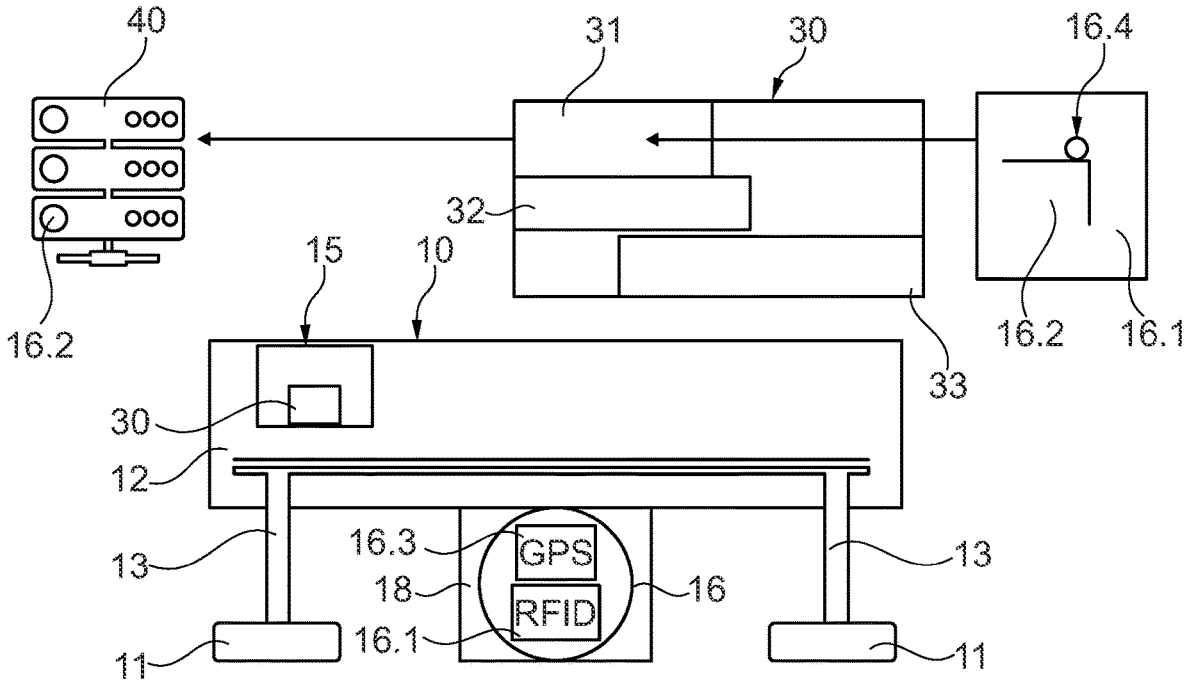

As FIG. 12 shows, the characteristic feature 16.4 is transferred from the storage unit 16.1 to the processing device 30, e.g., manually, and stored in the memory 31 for definite features, for instance.

Figure 14:
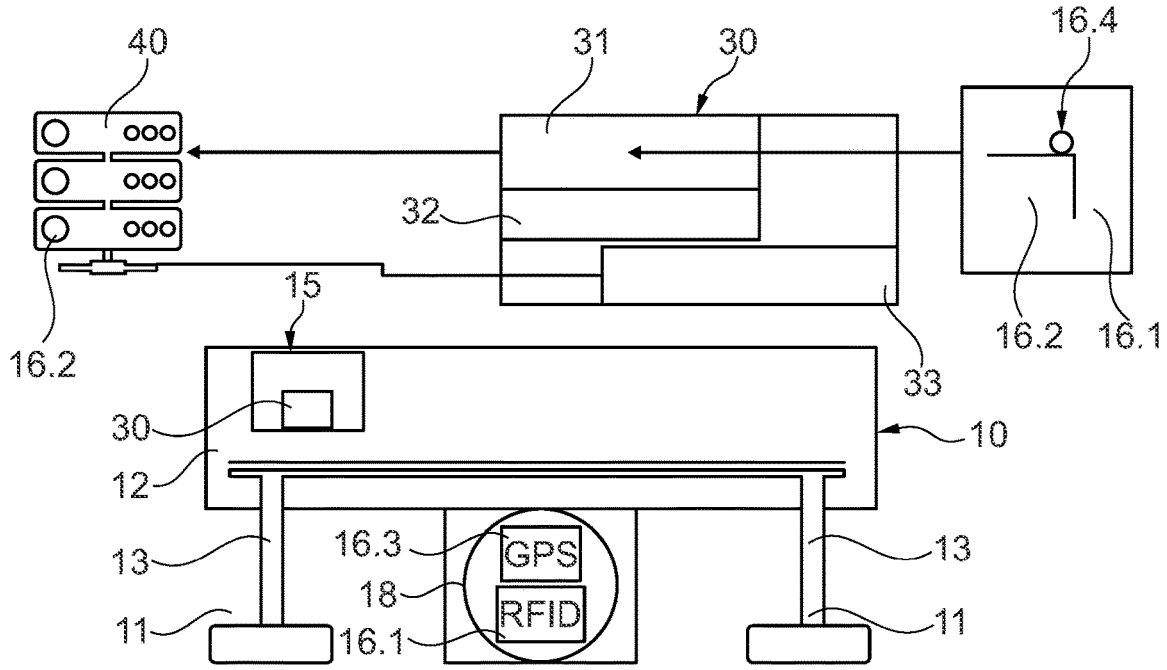

FIG. 14 illustrates that the ground milling machine 10 sends information to the computing unit 40 via the data line. In this case, the computing unit 40 is informed that the milling drum 16 with the characteristic feature 16.4 is installed or is to be installed at the ground milling machine 10.

At this point, both the separate computing unit 40 and the ground milling machine 10 have knowledge that the particular milling drum 16 having the characteristic feature 16.4 is installed at the ground milling machine 10. The data set 16.2 stored in the computing unit 40 and linked to the characteristic feature 16.4 can now be transmitted to the processing unit 30 of the ground milling machine 10 and stored in the storage units 31 and/or 32. Accordingly, the variable features and/or the computed and combined features contained in the data set 16.2 are transmitted to the processing device 30.

Figure 15:
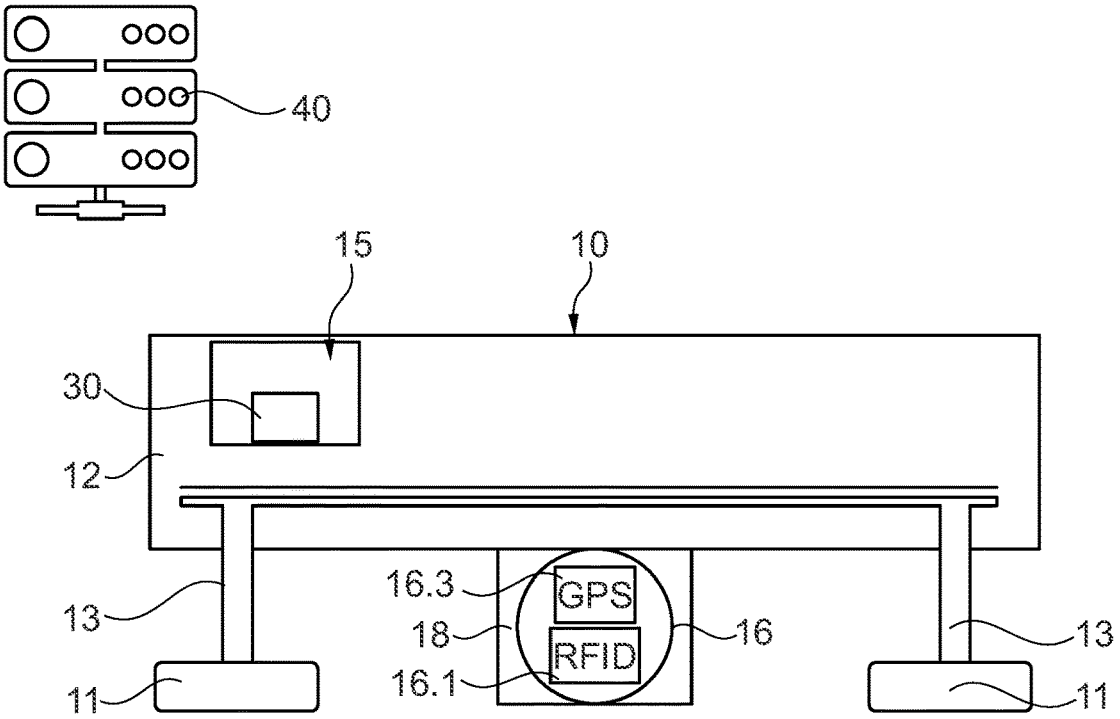

According to FIG. 15, the ground milling machine 10 is set in milling mode. According to FIG. 7 and the explanations given above, one or more relevant operating variables are recorded during the milling operation.

An additional data set is generated from one or more of the recorded relevant operating variables continuously or at intervals or at the end of the milling task. According to the exemplary embodiment according to FIGS. 1 to 9, a new data set is generated from the data set 16.2 and the additional data set. This new data set then forms the data set 16.2, which contains information on the current state of the milling drum 16.

In the exemplary embodiment shown in FIGS. 10 to 17, the new data set is generated in the ground milling machine 10. However, this is not mandatory. Rather, it is also conceivable that the ground milling machine 10 transmits the additional data set to the computing unit 40. Because the data set 16.2 is also present in the computing unit 40, the new data set can also be generated in the computing unit 40 and stored there and/or re-transmitted to the ground milling machine 10.

Figure 16:
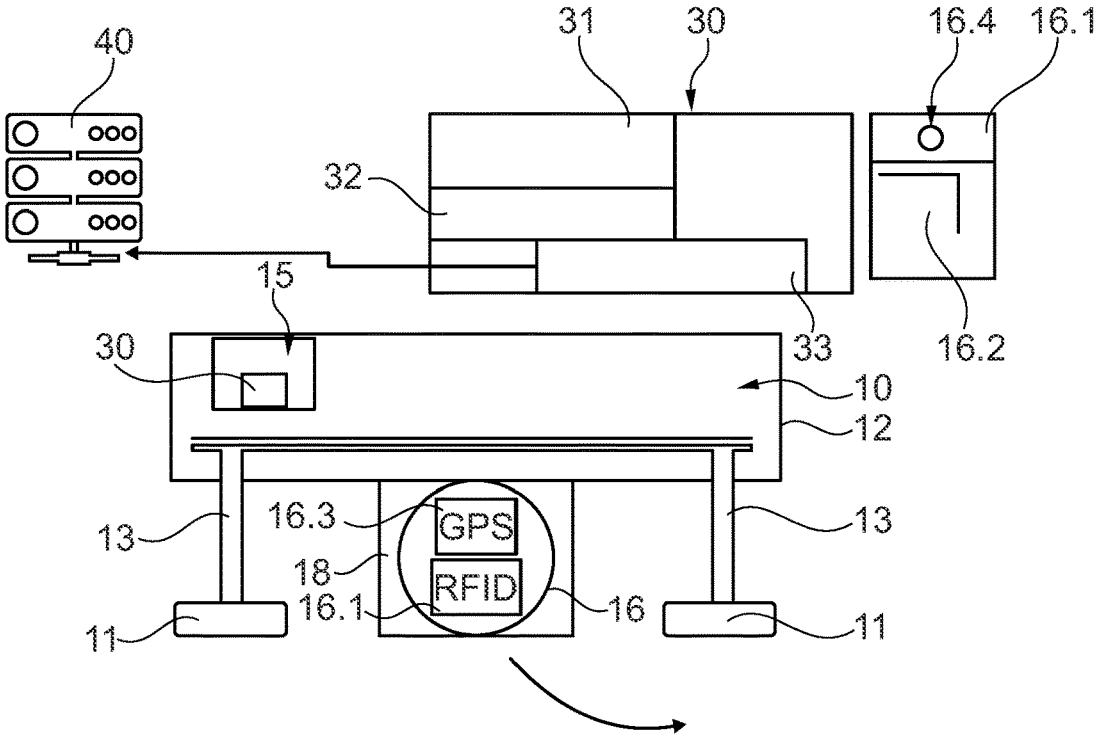
Figure 17:
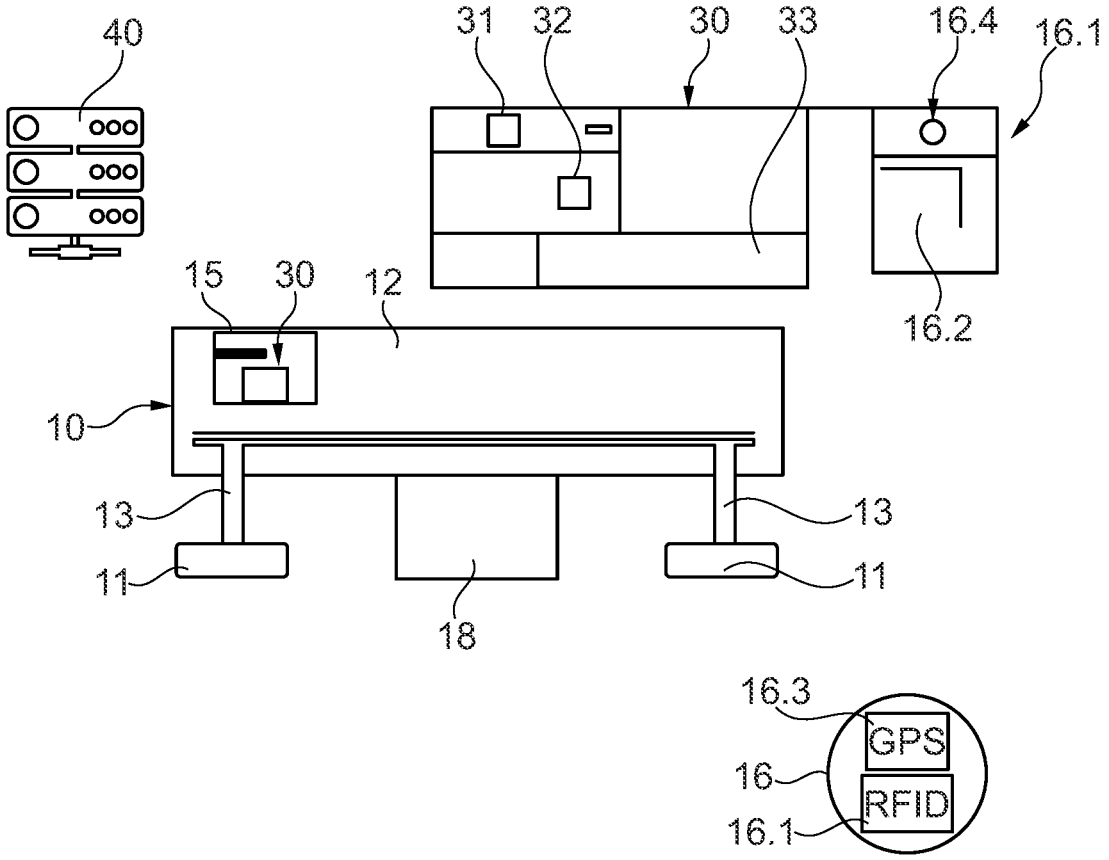

FIG. 16 further shows that after the milling task has been completed, the milling drum 16 can be removed and stored separately, as FIG. 17 shows.

FIG. 17 further shows that at least one of the memories 31 to 33 can be erased upon completion of the milling task.

Figure 18:
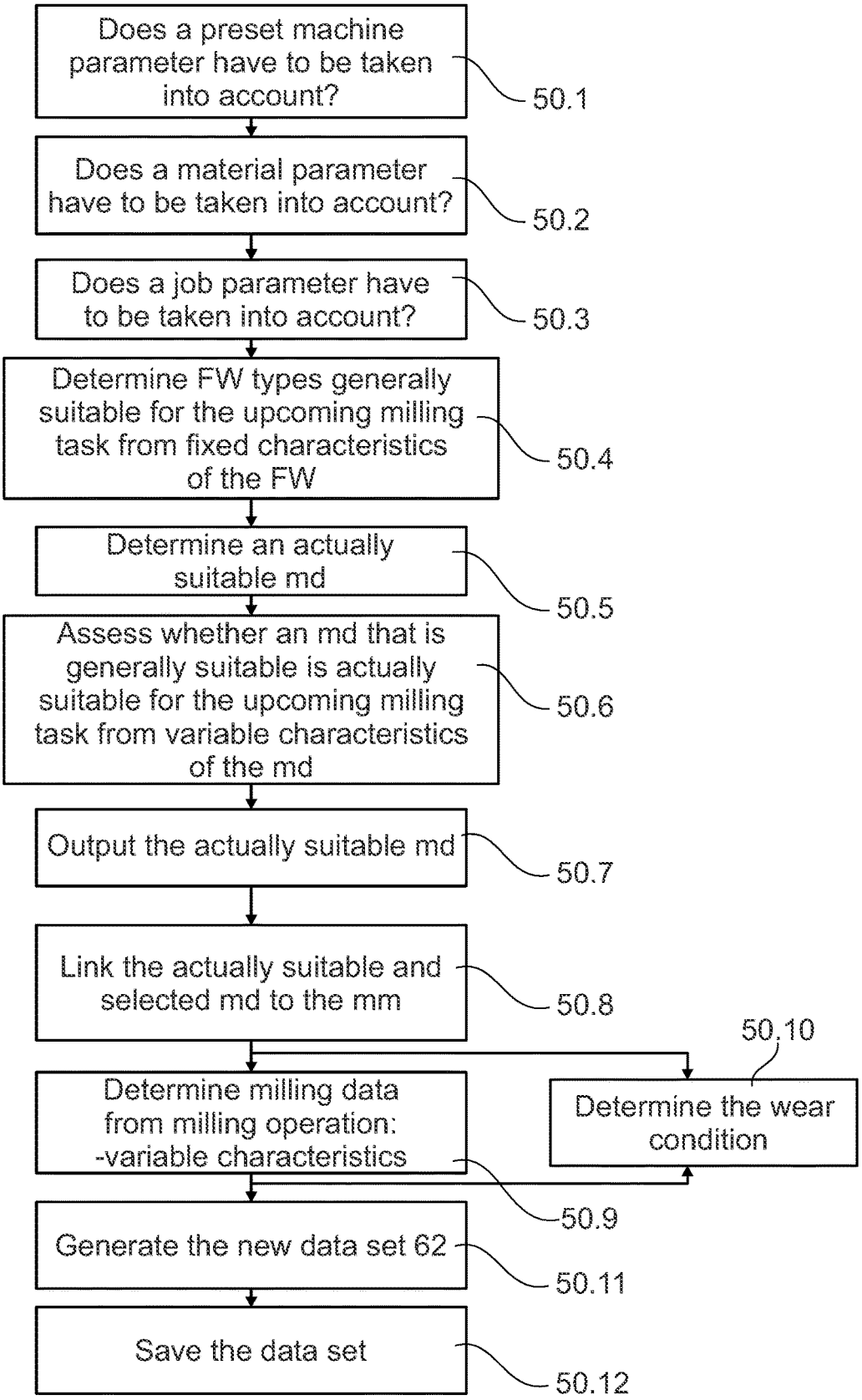
FIG. 18 shows a flow chart for determining a suitable milling drum for a milling task.

FIG. 18 shows a further development of the invention that can be used in a ground milling machine 10 according to the invention.

FIG. 18 shows a flow chart. Various blocks 50.1 to 50.12 are indicated in the flow chart.

According to block 50.1, the machine operator is asked whether one or more preset machine parameters are to be taken into account. If the machine operator wishes to enter a default machine parameter, such as a desired feed, a desired milling drum speed, a desired milling depth, a desired drive power for the milling drum 16, and/or a desired drive torque for the milling drum 16, these can be entered, for instance, via the control unit 15 at the control station 14.

According to block 50.2, the machine operator is asked whether one or more material parameters of the material to be milled are to be taken into account. If the machine operator wishes to enter one or more material parameters, the machine operator can do that, for instance using the control unit 15 at the control station 14.

According to block 50.3, the machine operator is asked whether one or more preset machine parameters are to be taken into account. If the machine operator wishes to enter one or more job data, the machine operator can do that, for instance using the control unit 15 at the control station 14.

It is conceivable that not all query blocks 50.1 to 50.3 are provided, but only one block or two blocks 50.1 to 50.3. The sequence of blocks 50.1 to 50.3 may also be changed.

According to block 50.4, a computing unit of the ground milling machine 10 determines the type of milling drum generally required for the upcoming milling task.

Block 50.5 determines, for instance using a further processing device, whether milling drums 16 of a suitable milling drum type are present in an actually existing pool of milling drums 16.

Taking into account the data sets 16.2 of the individual milling drums 16 actually present in the pool and considering the suitable milling drum type, then a determination is made, for instance based on the further processing device, whether a milling drum 16 is present in the pool that is actually suitable for the upcoming milling task (block 50.6).

In block 50.7, the operator is shown the actually suitable milling drum(s) 16 from the pool, it/they can be identified, e.g., by specifying the characteristic feature 16.4.

Block 50.8 illustrates that the actually suitable and selected milling drum 16 is connected to the ground milling machine 10.

Block 50.9 shows that the milling data of the ground milling machine 10 is acquired during or after the milling operation and the new actual current state of the milling drum is determined therefrom. Additionally or alternatively, provision may be made according to block 50.10 to determine the actual current state of the milling drum 16 by means of a detection device, for instance a laser scanner or a camera. In block 50.11, the new (updated) data set 16.2 is generated and stored according to 50.12, for instance in the computing unit 40 and/or the storage unit 16.1 of the milling drum 16.

What is claimed is:

1. A method for operating a ground milling machine having an interchangeable milling drum, wherein the milling drum is equipped with a plurality of milling tools, wherein the milling drum has a current state, wherein a control unit is provided for controlling at least one function of the ground milling machine, and wherein the milling drum is associated with a characteristic feature, the method comprising:

storing at least one data set containing information on the current state of the milling drum in a database, wherein the characteristic feature and the at least one data set are linked in the database, and wherein a computing unit separate from the milling drum comprises the database;

receiving, at the computing unit, a signal representing detection of the characteristic feature, wherein the data set linked thereto is retrieved from the database;

transmitting the data set to a processing device on the milling machine; and determining and applying one or more machine parameters for operating the milling drum to perform a specified upcoming milling task based on the current state of the milling drum.

2. The method of claim 1, wherein the milling drum has an active transmitting element that transmits the characteristic feature to a reader.

3. The method of claim 1, wherein the milling drum has a passive reading element, and a reader is used to detect the characteristic feature.

4. The method of claim 1, wherein the milling drum has a position transmitter configured to transmit a position signal, and the milling drum transmits the characteristic feature wirelessly in conjunction with the position signal.

5. The method of claim 4, wherein the position transmitter is a GPS transmitter.

6. The method of claim 1, comprising recording milling data during the milling operation of the ground milling machine, wherein the milling data or a computed combination of the milling data are combined as an additional data set with the data set and a new data set is generated therefrom, and wherein the new data set contains the current state of the milling drum.

7. The method of claim 6, wherein the recorded milling data comprises at least one piece of information selected from a group consisting of: a milling duration; a milled material volume; a milled surface; a milling depth; an average milling depth; a load profile; an average load profile; a mechanical load on the milling drum during at least part of the milling duration; an average load on the milling drum during at least part of the milling duration; a load on the milling tools; an average load on the milling tools; a number of overload events; information on a type of milled material; information on whether milling was performed with or without loading of the milled material; a feed and/or drive power of a drive motor transmitted into the milling drum; an average feed and/or average drive power of a drive motor transferred into the milling drum.

8. The method of claim 6, wherein the new data set is transmitted to the computing unit.

9. The method of claim 6, wherein the new data set is stored in the database as a data set containing information on a current state of wear of the milling drum.

10. The method of claim 1, comprising determining, via a further processing device, whether the milling drum is suitable for an upcoming milling task, based at least in part on the data set.

11. The method of claim 10, comprising:

detecting, via an input unit, at least one preset machine parameter and/or at least one material characteristic value of the material to be milled and/or job data; and determining, via the further processing device, whether the milling drum is suitable for an upcoming milling task from the at least one preset machine parameter and/or the at least one material characteristic value and/or the job data.

12. The method of claim 1, further comprising receiving an operator selection of a working mode via an input unit.

13. The method of claim 1, further comprising:

storing data sets corresponding to different milling drums in the database and/or a memory device;

determining, via the processing device, which of the different milling drums are suitable for the upcoming milling task;

informing a user on request which of the milling drums are suitable for the scheduled milling assignment; and upon selection and installation of one of the different milling drums on the milling machine, transmitting the data set corresponding to the selected and installed one of the different milling drums to the processing device on the milling machine.

14. The method of claim 1, wherein:

the data set contains at least one definite feature of the milling drum and/or the milling tools selected from a group consisting of: information on the type of milling drum; information on the state of wear of a pick holder in which the at least one milling tool is installed; information on the number of picks installed on the milling drum; and information on the line spacing of the milling picks on the milling drum.

15. The method of claim 1, wherein the data set contains at least one variable feature of the milling drum and/or the milling tools selected from a group consisting of: information on a state of wear of the at least one milling tool; information on a state of wear of a pick holder in which the at least one milling tool is installed; information on a state of wear of an ejector installed on the milling drum; information on a state of wear of a milling drum rotor of the milling drum; information on a residual wear capacity of the at least one milling tool; information on a residual wear capacity of the at least one pick holder in which the at least one milling tool is installed; information on a residual wear capacity of an ejector installed on the milling drum; information on a residual wear capacity of the milling drum rotor of the milling drum; information on a probability of failure of the milling drum; information on a quality of a milling texture, which can be generated using the milling drum; information on an efficiency of the milling drum; information on a usability of the milling drum.

16. The method of claim 1, wherein the current state of the milling drum comprises one or more wear components selected from a group consisting of: wear of one or more picks; wear of one or more pick holders; wear of one or more base parts, each of which holds a pick holder and is connected to the milling drum surface; wear at a milling drum rotor; wear at ejectors.

17. The method of claim 16, wherein the current state of the milling drum includes a tuple comprising at least two wear components considered in the data set.

18. The method of claim 1, wherein:

the current state of the milling drum includes at least one characteristic number, which is accounted for in the data set; and the characteristic number contains information on a remaining useful life of the milling drum, is derived from the remaining useful life of the milling drum, and/or indicates a residual wear capacity of the milling drum.

19. The method of claim 1, wherein the current state of the milling drum includes at least one qualitative assessment of the milling drum, which is accounted for in the data set.

20. The method of claim 1, wherein:

during or after completion of the milling task, the new current state of the milling drum resulting from the milling task is assessed or determined; and a new data set is generated taking this new current state of the milling drum into account, and further transmitted to the database and/or memory device.

21. A milling arrangement comprising:

a ground milling machine having an interchangeable milling drum, wherein the milling drum is equipped with a plurality of milling tools, wherein the milling drum has a current state and an identifying characteristic feature;

a control unit configured to control at least one function of the ground milling machine;

a database as part of a computing unit separate from the milling drum and configured to store at least one data set containing information on the current state of wear of the milling drum, wherein the characteristic feature identifying the milling drum is linked to the data set in the database; and a processing device on the milling machine and configured to transmit a signal representing detection of the characteristic feature to the computing unit, and to receive from the computing unit the data set or a computed combination containing the data set linked thereto, wherein the control unit is configured to determine and apply one or more machine parameters for operating the milling drum to perform a specified upcoming milling task based on the current state of the milling drum.

22. A method for operating a plurality of ground milling machines, each ground milling machine configured to perform milling tasks using a respectively selected one of a plurality of interchangeable milling drums, wherein each milling drum has a respective current state corresponding with a plurality of milling tools and further is associated with a respective characteristic feature, has a respective a current state, wherein a control unit is provided for controlling at least one function of the ground milling machine, the method comprising:

storing data sets containing information on the respective current states of each milling drum in a database, wherein for each milling drum the respective characteristic feature and data sets are linked in the database, and wherein a computing unit separate from any one of the milling drums comprises the database;

determining a suitable milling drum of the plurality of milling drums as suitable for a first milling operation to be performed by a first milling machine, based on at least the respective current state thereof;

receiving, at the computing unit, a signal representing detection of the characteristic feature for the selected milling drum, wherein the data set linked thereto is retrieved from the database and transmitted to a processing device on the first milling machine;

recording milling data during the first milling operation of the first milling machine, wherein the milling data or a computed combination of the milling data are combined as an additional data set with the data set and a new data set is generated therefrom, and wherein the new data set contains the current state of the selected milling drum; and uninstalling the selected milling drum from the first milling machine, wherein the selected milling drum is further selectable as a suitable milling drum of the plurality of milling drums as suitable for a second milling operation to be performed by a second milling machine, based on at least the respective current state thereof.

23. The method of claim 22, further comprising, for each of the respective first and second milling operations, and transmitting the data set linked to the selected milling drum to the respective processing device, determining and applying one or more machine parameters for operating the milling drum to perform the respective milling operation based on the current state of the milling drum.

* * * * *